US005990419A

United States Patent [19]

Bogese, II

[11] Patent Number: 5,990,419

[45] Date of Patent: Nov. 23, 1999

[54] DATA CABLE

[75] Inventor: Stephen B. Bogese, II, Roanoke, Va.

[73] Assignee: Virginia Patent Development Corporation, Roanoke, Va.

[21] Appl. No.: 08/918,866

[22] Filed: Aug. 26, 1997

Related U.S. Application Data

[60] Provisional application No. 60/024,580, Aug. 26, 1996.

[51] Int. Cl.[6] ..... H01B 7/00

[52] U.S. Cl. ..... 174/120 R; 174/120 SR; 174/113 AS; 174/113 R

[58] Field of Search ..... 174/97, 99 R, 174/110 PM, 113 R, 113 AS, 120 R, 120 SR, 102 SP

[56] References Cited

U.S. PATENT DOCUMENTS 2,583,026 1/1952 Swift ..... 174/117

*Primary Examiner*—Hyung-Sub Sough
*Assistant Examiner*—William H. Mayo, III
*Attorney, Agent, or Firm*—Saidman DesignLaw Group

[57] ABSTRACT

A primary conductor having a solid wire or wire strands that are enclosed by an insulating coating which has ribs that extend radially outwardly. The insulating coating provides electrical insulation between neighboring conductors. The ribs define air spaces which are between the ribs and space the insulated primary conductors from each other, thereby reducing the overall dielectric constant of the cable assembly. This in turn reduces the line-to-line capacitance between adjacent conductors, thereby minimizing Near End Cross Talk.

27 Claims, 4 Drawing Sheets

DATA CABLE

CROSS-REFERENCE TO RELATED APPLICATION

This application claims the benefit of U.S. Provisional Application No. 60/024,580, filed Aug. 26, 1996.

BACKGROUND OF THE INVENTION

Field of the Invention

The present invention relates to the insulating of primary conductors. Undesirable Near End Cross Talk (NEXT) between primary conductors or between twisted pairs (each comprised of two primary conductors) in a cable is primarily a function of capacitance. As a cable produces more capacitance, the amount of cross-talk also increases. In order to reduce the NEXT, the capacitance between the primary conductors or the twisted pairs must be reduced. Capacitance is dependent on two factors: (1) the center-to-center distance between the conductors, and (2) the combined or effective dielectric constant of all of the matter between the conductors or between the twisted pairs.

SUMMARY OF THE INVENTION

The present invention is concerned with the cross-sectional shape of the insulation of the primary conductors, i.e., the primary insulation. The cross-sectional shape is designed to have a starred or ribbed configuration whose radial arms separate the conductors or the twisted pairs and provide air spaces between them. Increasing the distance between the primary conductors or the twisted pairs lowers the capacitance, and inclusion of air spaces therebetween lowers the effective dielectric constant which lowers the capacitance. Both reduce the NEXT, thus improving the quality of the cable and substantially raising transmission speeds at which the cable can deliver electrical signals.

BRIEF DESCRIPTION OF THE DRAWINGS

The present invention will be more fully appreciated as the same becomes better understood from the following detailed description of the present invention when viewed in conjunction with the accompanying drawings, in which.

DETAILED DESCRIPTION OF THE PREFERRED EMBODIMENT

Figure 1:
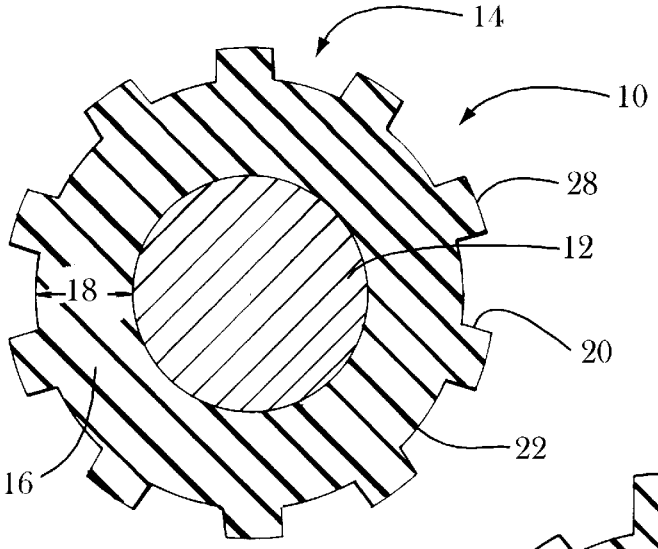
FIGS. 1–6 are cross-sectional views of insulated conductors which constitute preferred embodiments of the present invention.

When rating the quality of a cable, two transmission parameters are widely used: (1) the attenuation, and (2) the Near End Cross Talk (NEXT).

Attenuation is directly related to impedance which is primarily dependent on resistance and inductance; capacitance is also present but its effects on attentuation are negligible. Although these factors are related to the actual conductor configuration and not to the insulation surrounding the conductor, and attenuation is not the subject of this application, attenuation problems are involved as they set constraints upon the practical control of capacitance.

NEXT is directly dependent on the line-to-line capacitance of adjacent conductors within a single cable: the higher the capacitance, the higher the NEXT. If the NEXT is too high, the cable cannot deliver a clear signal because noise from one conductor interferes with signals on other conductors. In order to reduce the NEXT, the capacitance must be reduced. Minimizing the capacitance within the cable is a major objective of cable designers. Since capacitance is inversely proportional to the center-to-center distance between the conductors and proportional to the dielectric constant between the conductors, the two factors which must be taken into consideration are distance and dielectric constants.

Ideally, the designer of cables wants the conductors of the cable to be as far apart as possible, for this will minimize the inter-conductor capacitance. There are limits to how far apart they can be, however, for there are other considerations. Increasing the distance between primary conductors lowers the capacitance therebetween, but it increases the inductance which increases unwanted attenuation. Also, the size of the resulting cable imposes practical as well as economical constraints. A commercial cable cannot be so large that it is impractical to use in its intended environment, and it cannot be so large that it won't fit into connectors that are widely used for specific applications. The size of any cable is ultimately determined by the necessity of achieving a balance between these considerations.

So far as this invention is concerned, the primary area of interest is the reduction of the effective dielectric constant of the material, i.e., the average dielectric constant of the volume of space between the primary conductors, the space occupied by the combination of primary insulating material surrounding the primary conductors and the voids between the conductors. The effective dielectric constant between primary conductors is a combination of the dielectric constants of all of the materials which are present.

As is known, air has a dielectric constant of one; all other materials have dielectric constants above one. The best materials available for insulating conductors have dielectric constants greater than 2 when applied as a solid insulator. In order to reduce the dielectric constant, therefore, it is desirable to include as much air as possible between the conductors. The primary insulation, i.e., the insulation encasing the primary conductor, must have some structure, for it must protect the conductive wire and insulate it electrically from its conductive neighboring wires, the latter of which requires at least a minimum of dielectric properties. It is desirable, however, to provide as much air as possible between the primary conductors, for this will reduce the effective dielectric constant of the combination of all the intervening materials.

The thrust of activity in the art has been to trap gases between the conductors by surrounding each primary conductor with a foamed plastic. This increases the amount of gas or air trapped between the conductors. Coating a primary conductor with foamed plastic is effective as far as it goes, but it has its attendant problems. Foamed plastic is difficult to work with when using it to insulate a conductor and requires specialized, expensive equipment. It is especially difficult to work with in the field. Also, the foaming agent is believed to be environmentally detrimental. Finally, the foamed insulation tends to be unstable because foaming does not produce uniform pockets throughout the insulation. The present invention was created to overcome these problems.

The present invention reduces the NEXT, thereby improving the quality of the cable, by covering the primary conductor with a plastic insulation having an outer ribbed configuration. The ribs separate the conductors. The spaces between the ribs interpose air between the conductors. By creating as much air space as possible, and by selecting an insulation material which has an acceptably low dielectric constant consistent with structural stability, the effective dielectric constant, and thereby the capacitance and the NEXT, can be minimized.

FIGS. 1–6 show representative examples of insulation design according to the invention.

Turning to FIG. 1, an insulated conductor 10 comprises primary conductor 12 enclosed within an insulation 14. Primary conductor 12 can be a solid wire (FIG. 1) or wire strands (FIG. 7B). Primary insulation 14 is a plastic material, preferably a polyethylene or polypropylene, such as Himont SE191, but any acceptable material is within the purview of the invention. Insulation 14 is extruded onto primary conductor 12. Insulation 14 has an annular ring 16 of a finite radial thickness 18 for structural stability, shown exaggerated in the drawings for clarity. Thickness 18 cannot be so thin that insulation 14 will crack and/or peel, but it should be as small as possible to reduce its contribution to the over-all dielectric constant. Ribs 20 extend radially from conductor 12 and define spaces 22 therebetween. Ribs 20 include outermost ends 28, which are the portions of ribs 20 that extend the furthest radially from conductor 10. Ribs 20 separate conductor 10 from any neighboring conductor, thereby addressing the distance requirement. Spaces 22, when adjacent another ribbed conductor, provide air spaces between the conductors, which reduces the effective dielectric constant of the material between the conductors.

Some transmission cables come in the form of twisted pairs 24 (see FIGS. 7A, 7B, and 7C) in which a pair of insulated conductors 10 are wrapped in a shield 26. If the cable consists only of twisted pair 24, shield 26 is usually made of metal to act as an electrical shield. Under certain circumstances, depending on the projected work environment, it can be of plastic merely to hold conductors 10 together. When a plurality of twisted pairs 24 are joined together to form a larger cable, shield 26 may or may not be included, depending on the environment and customer requirements. The separation of adjacent conductors by the present invention is especially important in these circumstances. A larger cable comprising a large number of twisted pairs is usually surrounded by a metal screen, if electrical shielding is needed, and covered by an extruded layer of plastic, usually PVC.

Figure 7A:
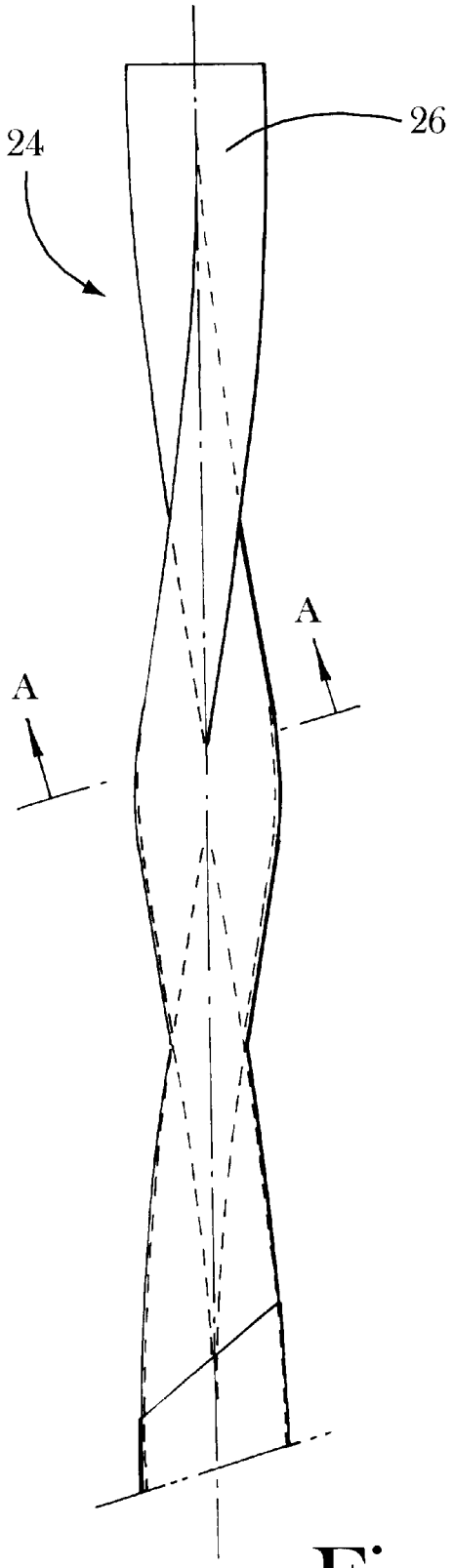
FIG. 7A is a side view of a twisted pair of conductors.
Figure 7B:
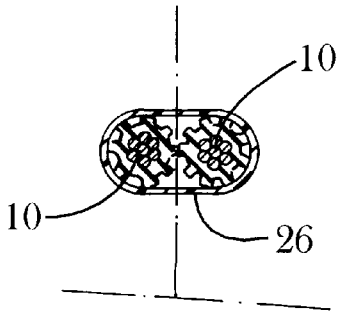
FIG. 7B is a cross-sectional view of the twisted pair of conductors of FIG. 7A as seen along line A—A of FIG. 7A.
Figure 7C:
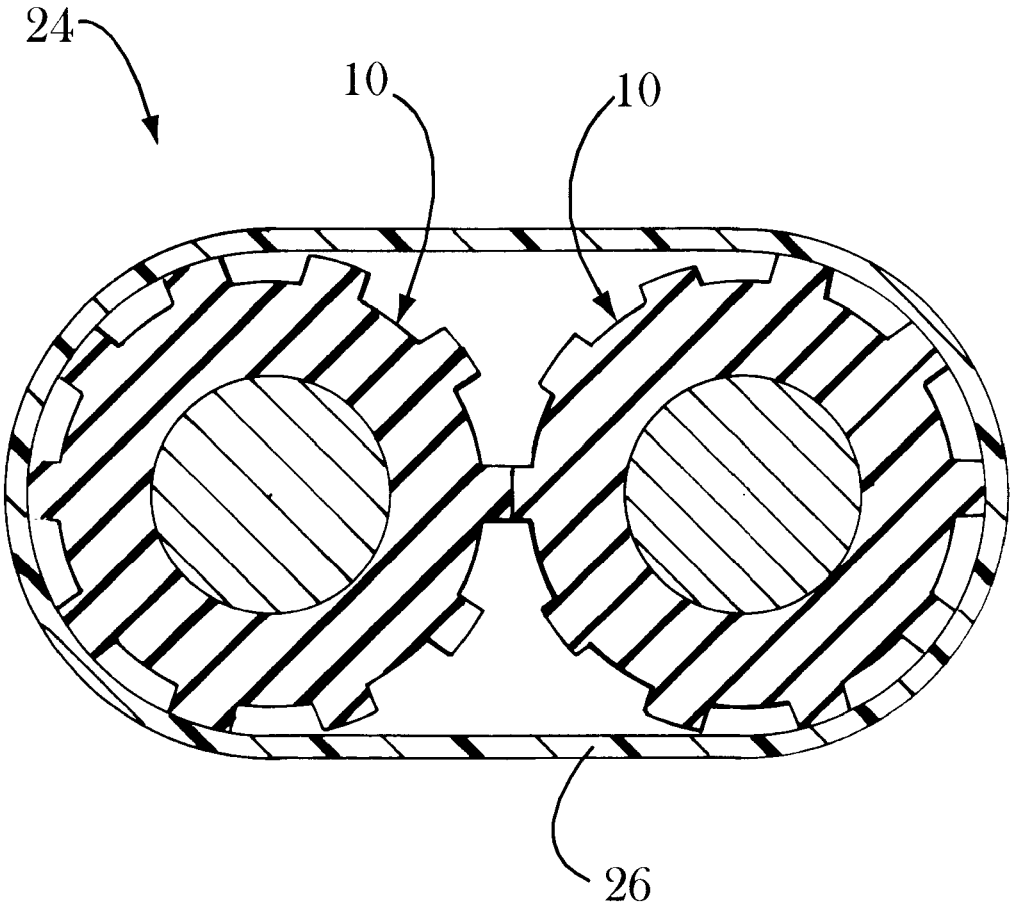
FIG. 7C is an enlarged cross-sectional view of an alternative embodiment of the twisted pair of conductors of FIG. 7A as seen along line A—A of FIG. 7A.

In the usual twisted pair cable 24, outermost ends 28 of ribs 20 of one conductor 10 will normally abut similar outermost ends 28 of ribs 20 of the adjacent conductor 10 to form a single twisted pair as shown in FIG. 7C.

Figure 2:
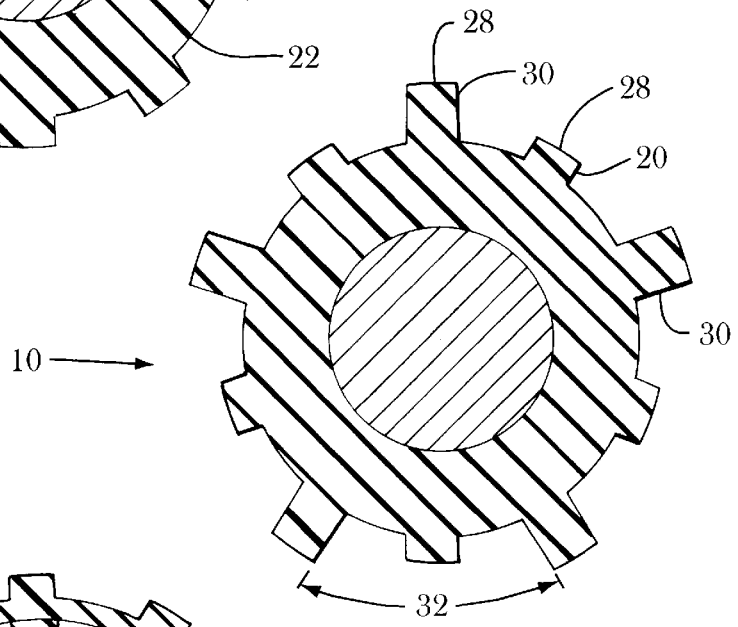

In FIG. 2, insulation 14 has longer ribs 30 alternating between shorter ribs 20. Not only does this space adjacent conductors 10 further apart than in the previous embodiment, both when ends 28 abut and when they do not, the configuration of FIG. 2 traps more air in the enlarged space 32 between ribs 30.

Figure 3:
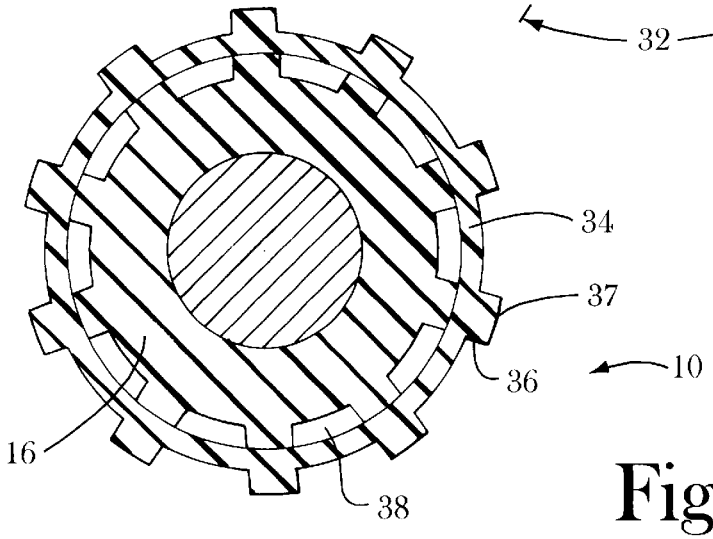

The insulation in FIG. 3 adds a ring 34 to the FIG. 1 embodiment. Ring 34 includes ribs 36 having outermost ends 37. Ring 34 gives insulation 14 structural stability while it entraps air within apertures 38 formed between ring 34 and ring 16. In the embodiment shown in FIG. 3, an outermost end 38 of rib 36 of one conductor 10 will abut an outermost end 38 of rib 36 of an adjacent conductor 10 to form a single twisted pair as shown in FIG. 7B.

Figure 4:
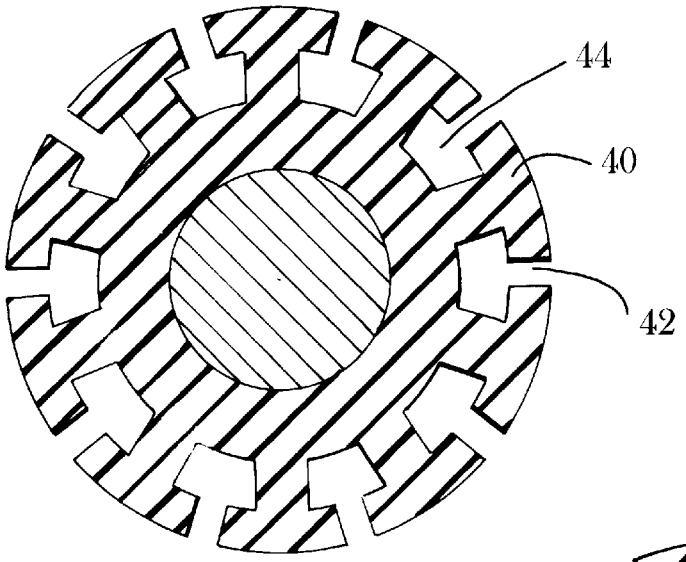
Figure 5:
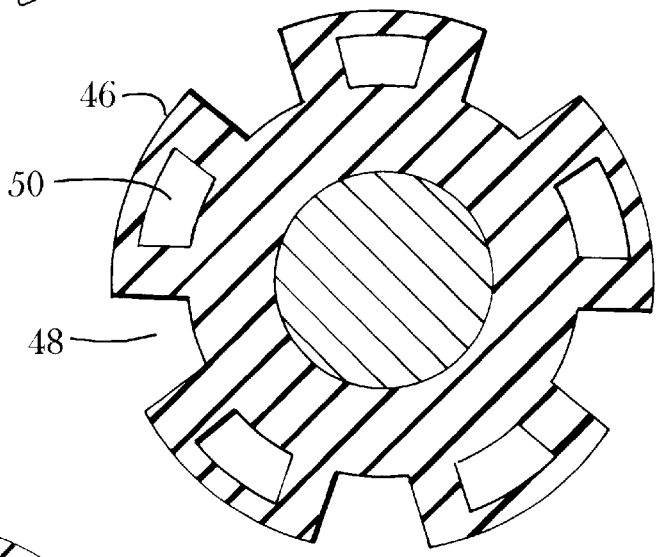
Figure 6:
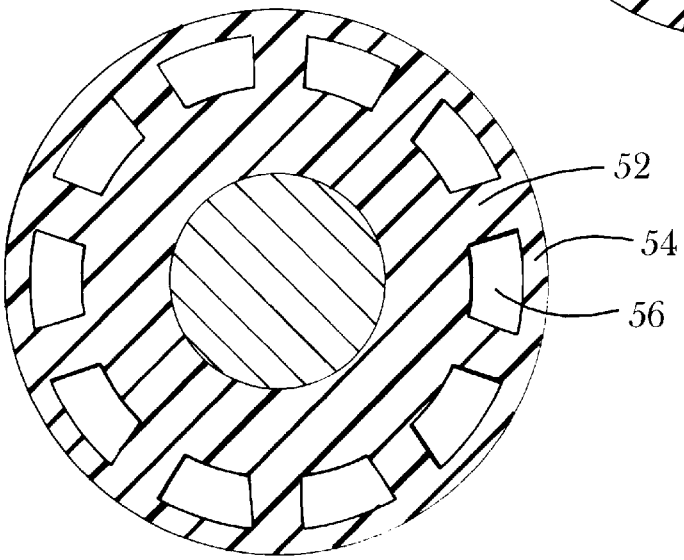

The possibility of a rib from one insulation of one twisted pair seating in an air space of one insulation of a second twisted pair can be eliminated, while including a relatively large air space, by making the angular extent of the outer surface of the ribs larger than the angular extent of the spaces. FIGS. 4–6 illustrate various embodiments accomplishing guaranteed separation of adjacent twisted pairs.

The FIG. 4 embodiment includes T-shaped ribs 40 whose annular length of the crossbar of the T is greater than the annular space 42 therebetween. Air is trapped in the trapezoidally shaped apertures 44 beneath the wings of adjacent Ts and between their tips.

D-shaped ribs 46 characterize the embodiment shown in FIG. 5. Air spaces 48 and 50 are created between and Within D-shaped ribs 46, respectively.

Increased structural stability is achieved with the FIG. 6 embodiment. Ribs 52 touch at their outer extremities an integral annular ring 54, defining air spaces 56 therebetween.

A top view of a twisted pair 24 of conductors 10 enclosed in a metal shield 26 is shown in FIG. 7A. A cross-sectional view along lines A—A is shown in FIG. 7B. An enlarged cross-sectional view of an alternative embodiment of twisted pair 24 of conductors 10 is shown in FIG. 7C.

NEXT increases directly as transmission frequency increases, and attenuation increases as transmission frequency increases. This comparison is referred to as S/N or signal-to-noise ratio, or as ACR or attenuation-to-crosstalk ratio. The frequency at which attenuation crosses below NEXT is the point that the cable is unusable because the crosstalk (noise induced onto a conductor) is greater than the unattenuated (remaining original) signal. At this frequency, the cable is only transmitting noise, and has an ACR=0. As ACR increases above zero, more signal is present than NEXT.

Extensive testing of the single layer rib insulation (FIG. 1) over a bare copper 24 AWG conductor (configured as a two twisted pair unshielded cable with a PVC outer insulation) illustrates the high transmission rates that this cable can handle. This cable in a length of 330 feet can operate above 500 MHz transmission frequency with an ACR exceeding 10 dB. This means that this cable has 10 dB more signal (remaining) in a conductor than the induced crosstalk noise on that same conductor. The best unshielded twisted pair cable currently offered in the market at 328 feet can only reach a 200 MHz transmission frequency with an ACR=10 dB.

Shielding any cable increases the attenuation which lowers the frequency at which NEXT crosses over and exceeds the attenuation or the remaining signal. This reduces and limits the transmission frequency of such cables.

The dual layer rib insulation (FIGS. 3, 7A and 7B) over a bare copper 24 AWG conductor, configured as a two shielded twisted pair cable with a PVC outer jacket, also shows outstanding electrical performance. At a length of 330 feet, this cable can operate above a transmission frequency of 360 MHz with an ACR=10 dB. This data illustrates that this shielded cable provides higher transmission rates than the best unshielded cables by utilizing ribbed insulation(s) on the conductors.

Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention as defined in the appended claims.

Further, the purpose of the following Abstract is to enable the U.S. Patent and Trademark Office, and the public generally, and especially the scientists, engineers and practitioners in the art who are not familiar with patent or legal terms or phraseology, to determine quickly from a cursory inspection the nature and essence of the technical disclosure of the application. The Abstract is neither intended to define the invention of the application, which is measured solely by the claims, nor is intended to be limiting as to the scope of the invention in any way.

It can be seen from the above that an invention has been disclosed which fulfills all the objects of the invention. It is to be understood, however, that numerous modifications and variations of the present invention are possible in light of the above teachings. Therefore, the disclosure is by way of illustration only, and the scope of the invention is to be limited solely by the following claims:

I claim as my invention:

1. A cable comprising:

a first insulated conductor;

a second insulated conductor located adjacent to said first conductor;

said first and second insulated conductors each including a primary conductor and an insulation enclosing said primary conductor;

each of said insulations comprising a first annular ring;

a rib extending radially from said first annular ring; said rib including an outermost end; and wherein said first and second insulated conductors are oriented so that said outermost end of said rib of said first insulated conductor abuts said outermost end of said rib of said second insulated conductor, thereby defining air space between said first annular ring of said first insulated conductor and said first annular ring of said second insulated conductor.

2. The cable of claim 1, wherein at least one of said primary conductors comprises a solid wire.

3. The cable of claim 1, wherein at least one of said primary conductors comprises wire strands.

4. The cable of claim 1, wherein said first and second insulated conductors each includes a first plurality of ribs extending radially from said first annular ring.

5. The cable of claim 3, wherein said first plurality of ribs consists of ribs of substantially equal radial height.

6. The cable of claim 3, wherein said first plurality of ribs consists of alternating ribs and intervening ribs, said alternating ribs having a greater radial height than said intervening ribs.

7. The cable of claim 3, wherein at least one of said first and second insulated conductors further comprises:

a second annular ring including a second plurality of ribs extending radially therefrom;

said second annular ring being located between said primary conductor and said first annular ring; and said second plurality of ribs forming air spaces between said first annular ring and said second annular ring.

8. The cable of claim 3, wherein each of said first plurality of ribs is T-shaped including an outer annular arm defining an air space between the outer annular arms of adjacent ribs, said outer annular arm further defining an air space between said outer annular arm and said first annular ring.

9. The cable of claim 7, wherein an annular length of said air space between the outer annular arms of adjacent ribs is less than the annular length of any one of said outer annular arms.

10. The cable of claim 3, wherein said first plurality of ribs are D-shaped, defining an air space within each of said first plurality of ribs and an annular air space between adjacent ribs.

11. The cable of claim 9, wherein the annular length of said air space between adjacent ribs is less than the annular length of any one of said first plurality of ribs.

12. A cable comprising:

at least one twisted pair including a first insulated conductor and a second insulated conductor, said first and second insulated conductors being twisted together;

said first and second insulated conductors each including a primary conductor and an integral insulation enclosing said primary conductor;

said insulation comprising a first annular ring;

a rib extending radially from said first annular ring; said rib including an outermost end; and wherein said first and second insulated conductors are oriented so that said outermost end of said rib of said first insulated conductor abuts said outermost end of said rib of said second insulated conductor, thereby defining air space between said first annular ring of said first insulated conductor and said first annular ring of said second insulated conductor.

13. The cable of claim 11, wherein each of said primary conductors comprises a solid wire.

14. The cable of claim 11, wherein each of said primary conductors comprises wire strands.

15. The cable of claim 11, wherein said first and second insulated conductors each includes a first plurality of ribs extending radially from said annular ring.

16. The cable of claim 14, wherein said first plurality of ribs consists of ribs of substantially equal radial height.

17. The cable of claim 14, wherein said first plurality of ribs consists of alternating ribs and intervening ribs, said alternating ribs having a greater radial height than said intervening ribs.

18. The cable of claim 14, wherein at least one of said first and second insulated conductors further comprises:

a second annular ring including a second plurality of ribs extending radially therefrom;

said second annular ring being located between said primary conductor and said first annular ring; and said second plurality of ribs forming air spaces between said first annular ring and said second annular ring.

19. The cable of claim 14, wherein each of said first plurality of ribs is T-shaped including an outer annular arm defining an air space between the outer annular arms of adjacent ribs, said outer annular arm further defining an air space between said outer annular arm and said first annular ring.

20. The cable of claim 18, wherein an annular length of said air space between the outer annular arms of adjacent ribs is less than the annular length of any one of said outer annular arms.

21. The cable of claim 14, wherein said first plurality of ribs are D-shaped, defining an air space within each of said first plurality of ribs and an annular air space between adjacent ribs.

22. The cable of claim 20, wherein the annular length of said air space between adjacent ribs is less than the annular length of any one of said plurality of ribs.

23. The cable of claim 11, wherein said at least one twisted pair is enclosed in a shield.

24. The cable of claim 22, wherein said shield is made of plastic.

25. The cable of claim 22, wherein said shield is made of metal.

26. The cable of claim 11, wherein said at least one twisted pair comprises two or more twisted pairs.

27. The cable of claim 25, wherein each of said two or more twisted pairs is enclosed in a metal screen.

* * * * *